United States Patent [19]

Uhlmann

[11] Patent Number: 4,856,703

[45] Date of Patent: Aug. 15, 1989

[54] METHOD FOR DRAWING SEAMLESS METAL TUBING PARTICULARLY COPPER TUBING UNDER INCLUSION OF A FLOATING MANDREL AND A DIAMETER REDUCING DIE

[76] Inventor: Klaus P. Uhlmann, Koenigstrasse 58a, D-5632 Wermelskirchen, Fed. Rep. of Germany

[21] Appl. No.: 275,585

[22] Filed: Nov. 23, 1988

[30] Foreign Application Priority Data

Nov. 24, 1987 [DE] Fed. Rep. of Germany ..... 3739730
Feb. 25, 1988 [DE] Fed. Rep. of Germany ..... 3805838

[51] Int. Cl.[4] ..... B23K 31/06; B21C 1/24

[52] U.S. Cl. ..... 228/156; 228/173.4; 72/283; 72/370; 72/430

[58] Field of Search ..... 72/283, 274, 280, 275, 72/209, 430, 370; 228/156, 173.4, 152, 155; 219/8.5

[56] References Cited

U.S. PATENT DOCUMENTS 2,335,939 12/1943 Hill ..... 72/285
3,494,165 2/1970 Preusch ..... 72/370

FOREIGN PATENT DOCUMENTS 1602318 2/1971 Fed. Rep. of Germany ..... 72/274
2425697 12/1974 Fed. Rep. of Germany ..... 228/156
14495 1/1982 Japan ..... 228/173.4
149038 9/1982 Japan ..... 228/173.4
755376 8/1956 United Kingdom ..... 72/283

*Primary Examiner*—Daniel C. Crane
*Attorney, Agent, or Firm*—Ralf H. Siegemund

[57] ABSTRACT

A method for drawing seamless metal tubing particularly copper tubing under inclusion of a floating mandrel and a diameter reducing die wherein the wall thickness is reduced under cooperation of the mandrel and of the die in an action zone defined by a drawing gap between the mandrel and the die, a drawing force is applied to the drawn tube downstream from the die, a plurality of tubings are connected to each other end-to-end thereby providing a joint in each instance of connection; normally and regularly the tubing is drawn in portions not havng any point; the die is shifted in the direction of drawing while holding the mandrel as the joint approaches, or the mandrel is shifted while the die is held; the tubing is hollow drawn in and adjacent to the joint without the mandrel being in the action zone of the die for reducing the diameter of the tubing with little or no concurring reduction in the wall thickness; subsequently the mandrel or the die is returned to the action zone of the die after the joint has passed through the die so that regular drawing can be resumed.

19 Claims, 5 Drawing Sheets

METHOD FOR DRAWING SEAMLESS METAL TUBING PARTICULARLY COPPER TUBING UNDER INCLUSION OF A FLOATING MANDREL AND A DIAMETER REDUCING DIE

BACKGROUND OF THE INVENTION

The present invention relates to a method of drawing seamless metal tubing, particularly copper tubing or pipes under utilization of a floating mandrel being disposed and working inside the hollow as it is being drawn and under further utilization of a die which reduces the outer diameter of the tubing pursuant to the drawing and wherein the wall thickness of the hollow being drawn is reduced under cooperation of the mandrel and the die while a drawing force is applied to the tubing as it has been drawn downstream from the die.

The modern manufacture of seamless copper tubing follows basically the procedure outlined above whereby particularly a solid block is first converted e.g. through hot rolling or press working into a hollow and this hollow is then reduced as far as wall thickness as well as outer diameter is concerned e.g. by means of a cold working pilgrim step like mill. Thereafter the tubing is drawn in several stages under utilization of dies and mandrels to obtain the final dimension. The tubing made is an intermediate product by the pilgrim step method is prepared in that a mandrel as well as drawing oil is introduced in the tubing, and then the end of the tubing is narrowed or tapered so that in fact one can "thread in" the tubing, into and through the drawing die. The preparation for the next drawing step is similar whereby it might be advantageous to have cut off the narrowed point or tapered end of the tubing as per the previous step.

All this procedure is rather time consuming and cumbersome and to some extent wastefall. Many tests have been conducted to reduce the preparatory steps and surrounding work procedure. It has been suggested for instance to provide the pointed or tapered end of the tubing in such a manner that the same tape end can be used for threading the tubing into several dies for sequential drawing passes. Another method lead to the development of preparing the length of the tubing during a period of time while the preceding tubing is still being drawn and processed.

Unfortunately it was found that all these method and improvements are disadvantaged by very high expenses in machinery and equipment. It has also been suggested to provide thick wall tubing and pipes in such a manner that certain short sections are made initially by press working or rolling and they are interconnected through end-to-end or butt welding so that one obtains a rather long string of tubular length for further procedure. Here then a short tube section is rotated fast and welded at the end in this kind of preparatory process.

However, it was found that the welding seams made in such a manner do not have the adequate strength in many cases so that a string of tubing composed of these welded short sections cannot really be pulled through the die without incurring further problems because the mandrel—die cooperation is not in a position to provide the requisite forces owing to the weakness of these various welding seams.

DESCRIPTION OF THE INVENTION

It is an object of the present invention to provide a new and improved method for drawing seamlessly made metal tubings particularly copper tubing wherein the time consuming narrowing or tapering of one end for purposes of threading into the die and also the capturing of that beginning downstream from the die can be either completely avoided or limited to a considerable extent.

In accordance with the preferred embodiment of the present invention the method as per the object is attained in that two or more tube length sections are interconnected prior to drawing that just passed through the connection is preferably made through bonding, soldering or welding. The mandrel is removed from the action zone of the die whenever a joint runs through the die so that the joint portion of the metal tubing will be drawn through the die for diameter reduction but without reducing the wall thickness and that following the passage of the joint the mandrel is returned through the action zone of the die and the pulling force acts on the drawn portion of the tubing but upstream from the joint.

It can thus be seen that a significant advantage of the invention obtains in that during the time in which actually the joint would be exposed to the transmission of drawing forces if full and complete drawing were to take place, these forces as the die acts on the tubing are drastically reduced. During this period the wall thickness of the hollow is not reduced but the hollow is pulled through the die which of course entails a certain reduction in diameter, but without simultaneously reducing the wll thickness. Consequently a considerably smaller amount of pulling and drawing force is required. As far as the length of the tubing is concerned only the very first end has to be narrowed and tapered in diameter, for purposes of threading it into and through the die. All the other tube lengths are connected to the first one in an endless fashion so that one after the other are indirectly threaded to the die namely through the stated procedure, and they are pulled through the die under the stated conditions. This means that the throughput of the machine is considerably increased. Of course it is required that the downstream stages for further drawing are attuned to the reduced internal diameter of the tubing. As the preferred form of interconnecting sorts and section welding is used or argon arc welding or the like is used; press welding is likewise conceivable.

In furtherance of the invention the end portions of the tubes to be interconnected are provided with recesses in the wall such as longitudinal slots so that the mandrel becomes accessible from the outside. These recesses could be narrow just to prevent gripping through of a tool for holding a mandrel and/or moving it. However, the cutouts may cover in toto at least actually more than half of the circumference of the tube wall. This means that any welding can be carried from the inside which in turn means that any burr can be removed. Most importantly however during drawing the mandrel will free itself from the action zone of the die when the cutout is reached. Alternatively as stated the mandrel can be temporarily displaced through mechanical action from the outside in which case the cutout can be smaller. Here a suitable hook may act on the mandrel to pull it out of the action zone of the die. In either case relative movement of the mandrel is in a direction opposite direction of movement of the tubing and drawing. Following the temporary displacement of the mandrel relative to the die the mandrel is preferably held for a while while drawing continues through electromagnetic means which will release the mandrel whenever the joint of tubes has passed through the die. The mandrel can move back in the action zone. The pulling and drawing force as seen in the direction of running the tube will act again behind i.e. upstream from the joint and the procedure can continues as normal. The electromagnet can actually engage the mandrel to control the entire displacement procedure.

For loosening the mandrel from the working position it may be of advantage to shift the die temporarily in the direction of drawing and back again. This particular feature in combination with an electromagnet is very advantageous. Following the passage of the joint the area of the mandrel is returned to the original position particularly after the mandrel has been pulled out of what was previously the action zone of the die. It is of advantage if the outer diameter of the tubing is actually reduced in the area of the joint as a preparatory step, prior to the drawing step. This can be carried out through cutting or the like whereby the inner diameter of the tubing is not affected. This reduction in wall thickness reduces further the drawing forces to be transmitted through the joint.

It is another advantageous feature of the invention to widen or increase the inner diameter of the tubing in those areas in which there is no wall thickness reduction. This feature offers the advantage that the mandrel be used during the next drawing step and stage, can be moved through the tubing without encountering any problem such as binding or the like. Between the die and the mandrel a force is exerted in radial direction at least on the portion of the tube wall and that portion of the wall is deformed so that the mandrel is retained by the deformed tube wall.

In the case of a flying mandrel as suggested here one will preferably use a mandrel which has a step. The portion with the smaller diameter predetermines the internal diameter of the drawn tubing. The reduction in wall thickness of the tubing is primarily determined by the conical transition or step of the mandrel from the larger to the smaller diameter portion. This determines mandrel configuration and the wall thickness which in addition is determined by the drawing cone of the die. The larger outer diameter of the mandrel has to be smaller than the hollow to be drawn in order to permit insertion into the hollow. On the other hand the larger diameter of the mandrel should be little larger than the inner diameter of the die so that the mandrel will not be pushed through the die at the end of the drawing process. The mandrel as well as the die actually have only then conical parts engage the hollow as it is being drawn. Here then at first die and mandrel are shifted simultaneously in the direction opposite drawing requiring a deformation force so that, as will be described, the die afterwards can be shifted all by itself in the direction of drawing.

Retaining the mandrel can preferably be obtained in that the tubing following the shifting of the die receives three indents which are displaced by 120 degrees and the mandrel is retained through the inner surfaces of these indents.

Basically it is possible to shift the die and to exert forces for deformation as the tubing moves slower through the equipment. However it was found to be of advantage to interrupt passage of the tubing through the die during shifting of the die and in the beginning when deforming forces act on the tube's wall. As forces begin to exert again on the wall the movement of the tubing and drawing is resumed; the drawing force will act just on the outside of the tubing until in fact the joint has passed througuh the die. It is important that the mandrel will reach the action zone of the die only thereafter and resume cooperation with the die for purposes of combined diameter and wall thickness reduction. This further drawing force must act on the tubing again only when the pulling is effective upstream from the joint that has just pressed.

Returning the die in the original position is carried out preferably after the mandrel has reached the action zone of the die. Return of the mandrel obtains by providing an indent in the tube wall and a position as seen in direction of tube movement in front i.e. upstream of the position of the mandrel. The retaining of the mandrel is carried out preferably in the following shifting the die the tubing will be drawn hollow through a divided, dielike tool or quasi-die which is positioned as seen in the direction of movement in front of the die such that the inner diameter of the tubing is reduced to below the largest diameter of the mandrel. Hollow drawn means in this context that there is no concurring wall thickness reduction.

Following the drawing and in preparation for further drawing steps, the tube could require a larger force when it comes to that zone which was hollow drawn in the preceding step. Therefore it is of advantage prior to the respective next or to any other drawing step, to soft anneal the hollow drawn area and zone. That means that cold working strengthening and hardening of the zone is to be reduced.

In furtherance of the invention equipment is suggested to carry out the method which equipment includes a die, a mandrel and drawing equipment for pulling the tubing through the die and wherein the die itself can be shifted in the direction of the longitudinal axis of the hollow to be drawn. In front of the die a tube wall deforming tool is provided constructed for example as a divided ring or it may include several sizing rollers. Also this forming tool may be a divided dielike tool with an inner diameter that is larger than the inner diameter of the drawing die. Such dielike tools or quasi-dies or pseudo-dies are available in rolling mills and can be changed through separating the die to two halves in order to match the equipment to the desired purpose. The accuracy of drawing in the this case does not have to be very great as far as this supplemental dielike tool is concerned so actually one may use here reworked regular dies which are no longer usable.

The tube ends are to be connected through soldering and welding and the dielike tool has as its sole purpose the retention of the mandrel until the joint has passed through the drawing die. This dielike tool can also be used for obtaining a slight wall reduction. In this case a controlled hollow drawn as defined above is carried out such that the dimensions of mandrel and die are attuned to establish an exactly defined drawing gap. This has the advantage that the inner diameter of the drawn tubing will not be reduced on account of the hollow drawing because such a reduction could impede the transport of the respective mandrel during the following drawing steps.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 illustrates seamless tubing 1 which is available in annular coils 7 and *7a* placed on a conical stand 2. This tubing 1 is taken from the lower coil 7 and passed through a die 3 which reduces the outer diameter as well as the wall thickness of the tubing resulting in tubing 6. The forces necessary for the drawing process will be provided by a carriage and drawing machine for having sets of brackets 5 which grip the drawn tubing 6, pull it through the die 3. These clamps or brackets open and close in alternate succession in phase opposition open so that one bracket grips the tubing 6 while the other one is permitting this bracket return to later grip the tubing anew. This equipment is in this regard conventional and constitutes background. The invention refers specifically to details of the operation and construction involving the die 3.

Figure 1:
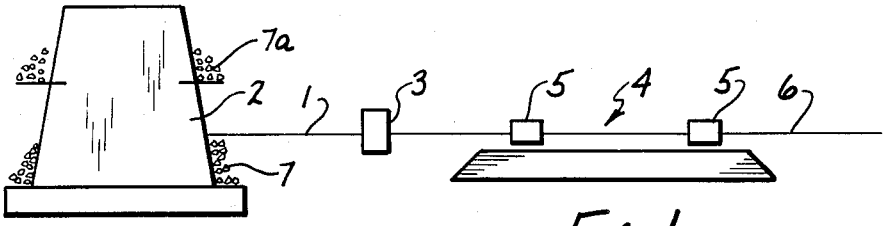
FIG. 1 is a schematic side view of equipment for practicing the preferred embodiment of the present invention in accordance with the best mode consideration.

In accordance with the teaching of the invention it is suggested to interconnect a plurality of tubular length. The connection is carried out ahead of time as far as the drawing is concerned but it is clear that a drawing of a long string of tubing can progress while, so to speak, in the upstream equipment portion the connection is made and continued. For purposes of such a connection a particular second coil *7a* is placed relatively speak available in relation to the coil 7 being worked at the present time whereby it is assumed that the two coils involve copper tubing of the same diameter and similar cross sectional contours and dimensions.

Figure 2:
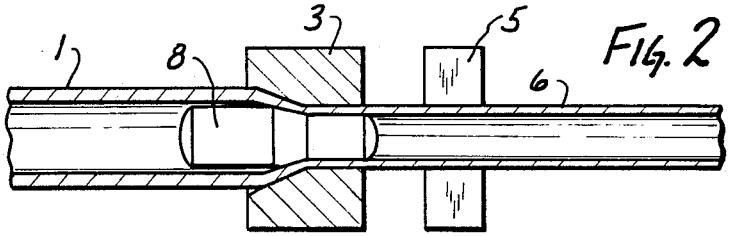
FIGS. 2 and 3 are cross sections through a drawing stage in different phases of operation.

As the end of the coil 7 is reached it is that end of the tubing that is to be connected to the beginning of the tubing of coil *7a*. The connection will be made by adhesive bonding welding or soldering. In the past welding has been practiced with llimited or no success for the following reason. FIG. 2 illustrates the arrangement of the die 3 and of a mandrel 8. The forces arising during drawing are so high that a joint made e.g. through soldering or welding will tear in the die or at least just a little downstream from the die. The mandrel floats during drawing by means of die 3, that is, the forces arising during friction equal the retention forces. In order to avoid tearing, the invention provides for a suitable remedy.

Figure 3:
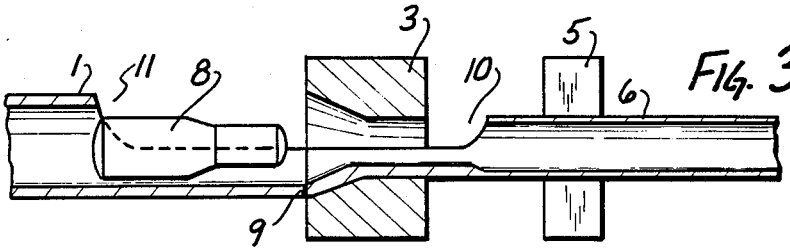

At the latest when a joint area 9 enters the die 3, the mandrel 8 will be shifted and displaced in the direction opposite the direction of drawing and will, therefore, no longer coact with the die on the tube's wall. This situatin is shown in FIG. 3. This means that the tubing particularly the upstream portion of the joint 9, the joint itself and a certain portion of the tubing downstream from the joint, will still be drawn for purposes of reducing the diameter but without incurring reduction problems because the tube's wall is not gripped and reduced from the inside by the mandrel. Rather, the mandrel 8 has been displaced and shifted out of the way. This way the tubes and joint areas are just "hollow drawn".

For purposes of mandrel shifting and displacement a finger may be provided in external equipment reaching through a slot of the tube's wall and pulls the mandrel back. Alternatively, there may be electro-magnetic retraction of the mandrel. Still alternatively, die 3 together with tube 6 may be displaced by pulling but the mandrel 8 will not follow but be held until a new position is attained on the die for purposes of limiting the action of the tubing. In the case shown in FIG. 3 certain cutouts 11 and 12 are provided which are in fact respectively at the end of one tubing and at the beginning of the next tubing both cutouts to be effective in the joint area 9. Just because there is a cutout means that the mandrel is automatically released as the cutout approaches. The mandrel 8 will retain the position until the end of the cutout 11 was reached. Here there may be provided an indent which as tubing 1-6 moves to the right carries the mandrel 8 along until the action zone of the stationary die 3 has been reached again whereupon normal process is resumed. This will particularly occur after the particular clamping bracket 6 acts upstream from the joint area 9 so that no pulling is provided on that joint.

The invention was described in conjunction with processing of tubes of copper tubing available in a coil but this of course is only background information simply because that is the way in many instances copper tubing comes. There is no essentially requirement that a coil be processed. The tubing may come in straight lengths. The machine providing the pulling force i.e. the equipment 4–5 can be of the variety illustrated by other types can be used e.g. drawing drums, shieves or the like with the V-shaped endless grooves all are feasible.

FIGS. 4–12 illustrate different examples of interconnecting a various tube length. All these connections and joints have in common that the mandrel can transit from one length, through the joint area to the tubing upstream from the point so that the strength of the joint has to be at least sufficient that forces can be transmitted as they arise during hollow drawing without the mandrel being effective as described.

Figure 4:
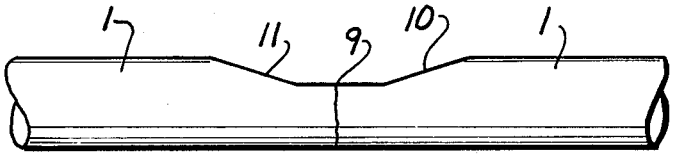
FIGS. 4, 5, 6, 7, 8 and 9 show different end-to-end connections of tubing to be drawn.

Turning now to details, FIG. 4 illustrates an end-to-end connection of two tubes 1 obtained through bonding, soldering or press (butt) welding or argon arc welding. The cut-outs 10 and 11 do not only serve the purpose as described but admit access to the interior of the tubing in the welded area as to permit the removal of any welding burr. In addition of course the mandrel can be manipulated through these cut-outs. If the cut-outs 10 and 11 actually cover more than 180 degrees then the mandrel will automatically be released as the cut outs pass through the die.

Figure 5:
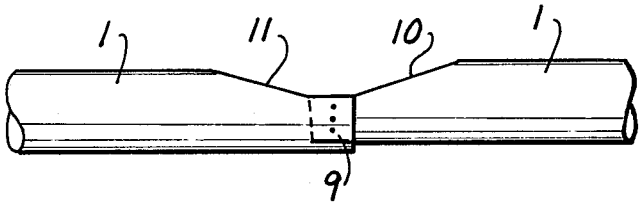
Figure 6:
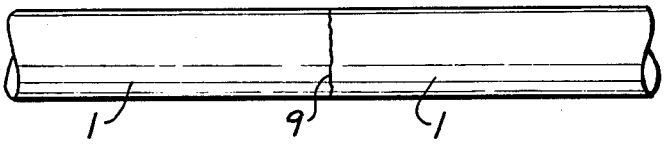

FIG. 5 illustrates the connection and welding seam 9 made through dot welding of overlapping ends. FIG. 6 shows again a butt connection 9 and again reference is made to bonding, soldering and welding. In this case no cutouts are provided and the mandrel is acted upon by electromagnetic forces e.g. using an annular electromagnet passed by the tubing 1 and provided to hold the mandrel 8. For supporting the retraction the die 3 may temporarily run with the tubing 1. Then, just before the joint area 9 passes through the die 3 the mandrel 8 is held by the magnet; thereafter the die is returned to its initial position and now the joint area is processed as described.

Figure 7:
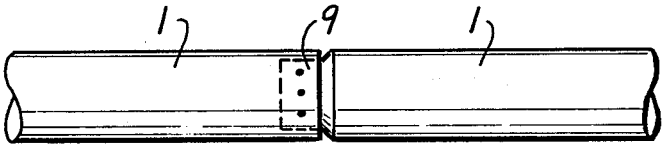
Figure 8:
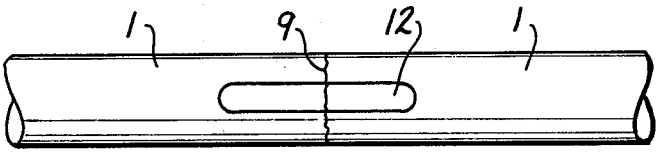

FIG. 7 illustrates a joint wherein a pointed end or a narrow end is inserted in the next one and is connected thereto through dot welding. FIG. 8 illustrates a joint similar to the one shown in FIG. 6 but with a longitudinal rather narrow slot 12 provided for purposes of inserting a finger or the like or a tool to engage the mandrel 8 so that the mandrel is shifted or held in relation to the moving tubing. In this case one may also use a magnet to hold the mandrel 8 following the retraction of the die and until the joint has moved past the area of drawing force application.

Figure 9:
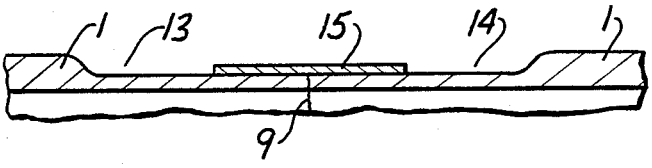
Figure 10:
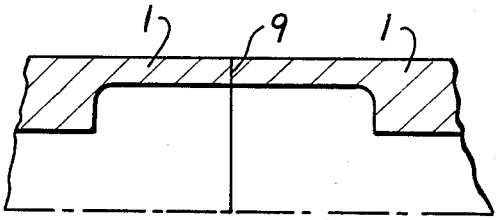
FIGS. 10, 11 and 12 show cross sections through still different prepared joint areas of interconnected tubings.
Figure 11:
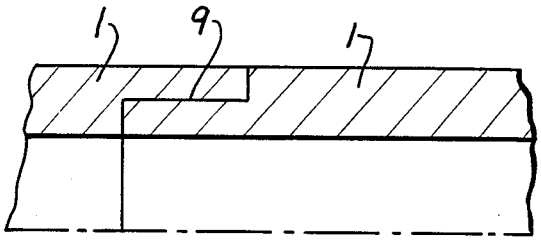
Figure 12:
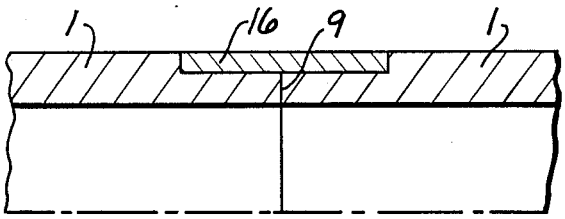
Figure 13:
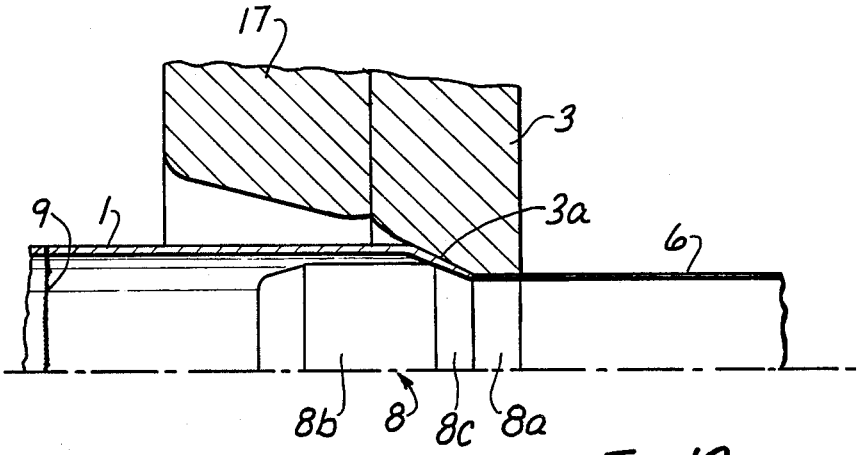
FIGS. 13–16 are detailed cross sections through the progressing phases of operation in accordance with the preferred embodiment of the present invention using an auxiliary or pseudo-die.
Figure 14:
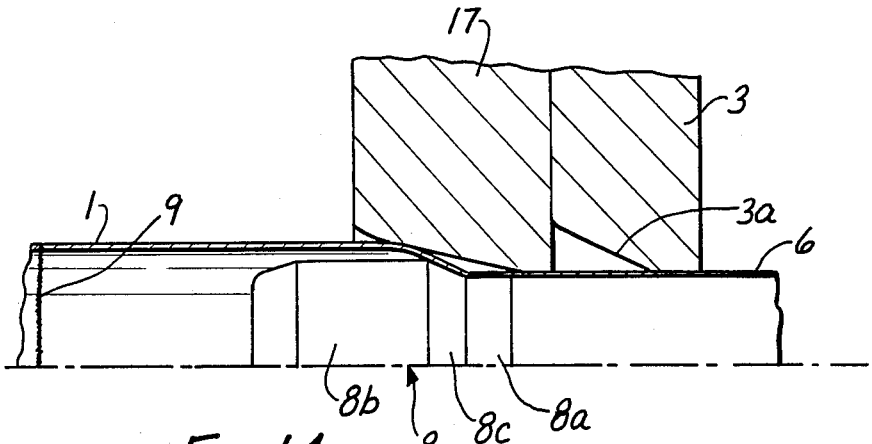
Figure 15:
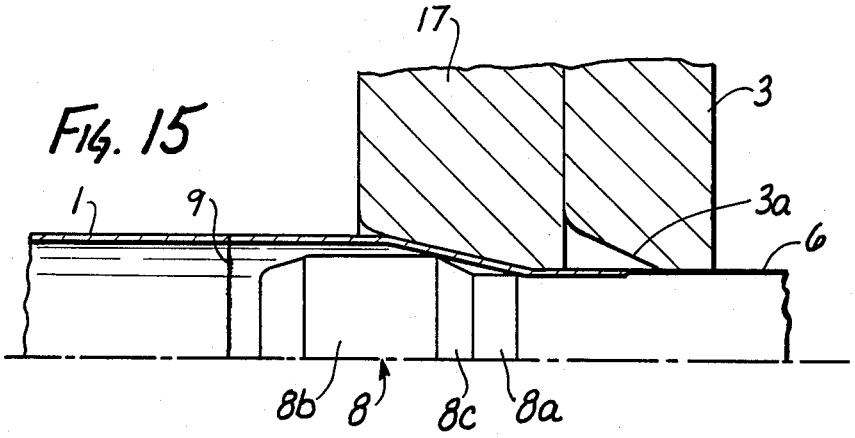

The joint shown in FIG. 9 has the outer diameter of the two ends of tubing 1 reduced. A copper sleeve 15 is shifted onto these reduced diameter areas 13 and 14 and is welded thereto through dot welding or through soldering or bonding. This particular embodiment reduces the drawing forces as they result from wall thickness reduction. In the case of the joint of FIG. 10 the inner diameter of the tubes is larger in the joint area (the seem 9 is butt welded). FIG. 11 shows a joint wherein the end of a certain tubing has its reduced outer diameter while the end of the next tubing has the inner diameter widened. This way the two ends can be plugged into each other and may then be soldered or otherwise connected. In the embodiment shown in FIG. 12 both ends are to be interconnected and soldered to a metal sleeve 16.

FIGS. 13–16 illustrate more fully details of the method involved while FIGS. 17–21 show advantageous pieces of equipment to be used in the process. During normal drawing die 3 and mandrel 8 cooperate to reduce wall thickness as well as diameter of tubing 1. The drawing gap between the inner diameter of die 3 and the outer diameter of part 8*a* of mandrel 8 determines the wall thickness of the tube 1–6. Since the outer diameter of part 8*b* in the mandrel 8 is larger than the smallest inner diameter of the drawing die 3, mandrel 8 is actually prevented from travelling and from being pushed through the die opening. On the other hand, the friction forces acting on the surface of the part 8*a* of the mandrel cause the mandrel to actually be pushed into the drawing cone 3*a* of the die 3.

The conical transition 8*c* from wider diameter part 8*a* of the mandrel to the smaller diameter part 8*b* is preferably shallower than the drawing cone 3*a* of the die, so that actually the wall thickness is reduced gradually. In the case of a matching selection of the cross section of the tubing on one hand and of wall thickness reduction on the other hand, the cross section of the drawn tubing 6 suffices in order to transmit the drawing forces that arise as the tubing 6 is pulled into and through the gap. In order to provide for an economic way of manufacturing one usually operates close to the maximum possible and permissible wall thickness reduction. However, in that case the forces will be too large to be transmitted through a welding zone such as 9 so that in the normal state a welding area may readily be expected to rupture.

Now as per the invention is the welded or soldered connection 9 between two interconnected lengths of tubing approaches the die 3, the drawing process is actually interrupted. The die 3 is moved in the direction of drawing by a little path length to thereby indirectly shift the mandrell 8 out of the action zone of the die. The mandrel will in fact remain stuck in the part of the tube that was just deformed by the cone 3*a* (see FIG. 14). Now in order to release the mandrel 8 from the stuck position but to retain it. Otherwise, a dielike tool (pseudo-die) 17 is provided which is comprised of two parts with a radial dividing plane.

As the die 3 has been removed from what was the last action zone it is replaced by this quasidie 17 and which is provided for interconnection of its part right at the mandrel 8. As now the drawing and pulling process of the tubing continues the mandrel 8 actually is released but is retained through the pseudo-die 17. During this particular phase only, the inner diameter of the tool 17 acts on the tubular wall without working with the mandrel. This means that there is a diameter reduction without concurring reduction in wall thickness. This is shown e.g. in FIG. 15.

Figure 16:
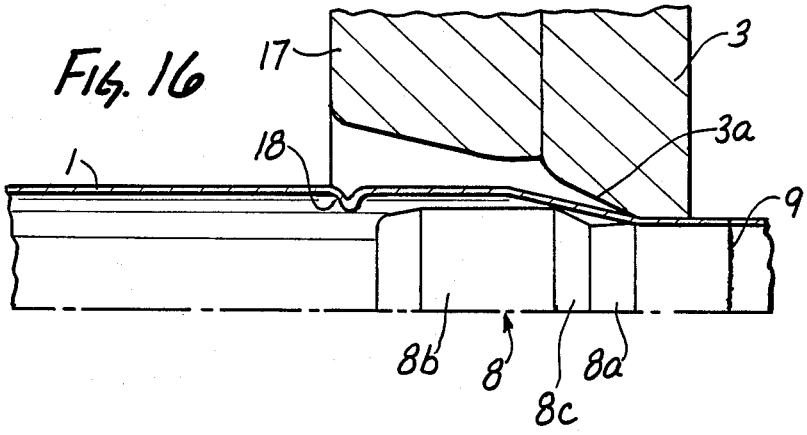

As the pulling process continues, soon the joint and seam 9 will be situated downstream from the drawing die (FIG. 16) whereupon the tool 17 is separated, releasing the mandrel 8 as is also shown in FIG. 16.

An indent 18 has been formed into the tubular wall before the drawing process and this projection 18 as far as the interior of the tube is concerned, causes and takes along the mandrel 8 and moves it towards the drawing gap and die 3. Now as the joint 9 has passed the wall thickness can be reduced again. Retraction of the tool 17 and a return movement of the die 3 as described are all steps which can be carried out during the drawing process. On the other hand there is a possibility to move tool 17 and die 3 from the position shown in FIG. 14 in the direction opposite the direction of drawing while the drawing is actually discontinued temporarily. Here it is necessary to hold the tubing 6 until the return of the die 3 has been completed.

Another possibility is shifting of the die 3 and of the mandrel 8 opposite the direction of drawing during the drawing process and shifting in addition the die 3 following stopping back again in the direction of drawing.

Figure 17:
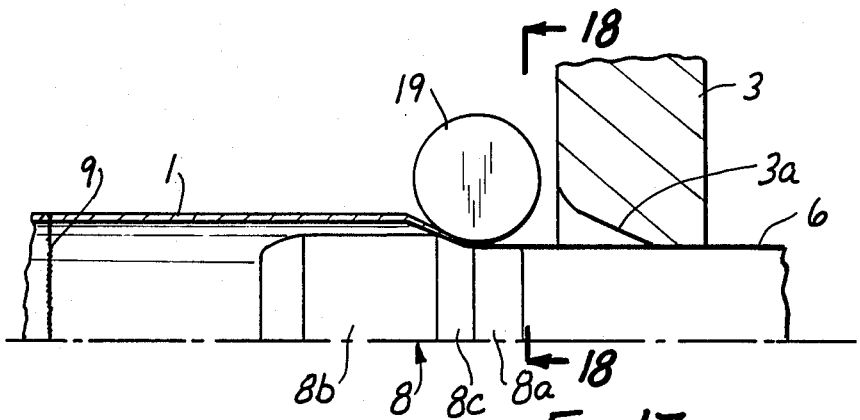
FIG. 17 is a cross-section through equipment wherein the pseudo-die of FIGS. 13–16 has been replaced by rollers.
Figure 18:
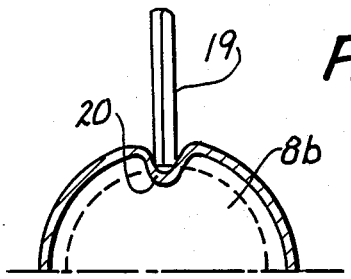
FIG. 18 is a cross section as indicated through line 18 in FIG. 17.

In the example shown in FIGS. 17 and 18 the quasi or pseudo-die and tool 17 is replaced by a contour roller 19, providing and impressing a little indent into the tubular wall which will release the mandrel 8 from the active zone of die 3 and hold it back. Preferably one will distribute three such rollers 19, more or less uniformly around the circumference of the tubing. Only one of these rollers is illustrated and the others are analogously displaced by 120 degrees. The rollers 19 are moreover adjustable in the direction toward the center axis of the tubing 6.

Following passage of the seam 9 through the drawing die these rollers are retracted just as before the tooling 17 is retracted. The main idea is to release the mandrel 8.

Figure 19:
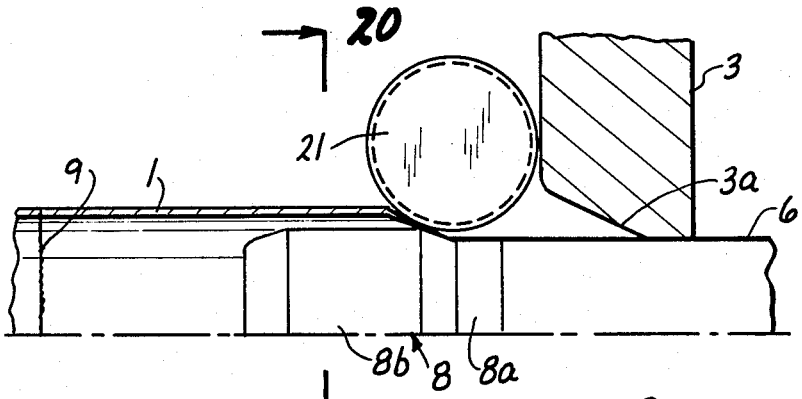
FIG. 19 is a cross-section with still other tubing.
Figure 20:
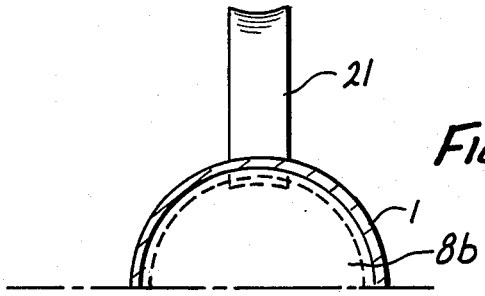
FIG. 20 is a cross section as indicated line 20.

FIGS. 19 and 20 show a tool which is comprised of a plurality of adjustable contour rollers 21 only one of them is shown and these rollers will be moved forward, following the retraction of the drawing die 3, so that the resulting rolling gap is capable of holding the mandrel 8 and retain it from the outside.

Figure 21:
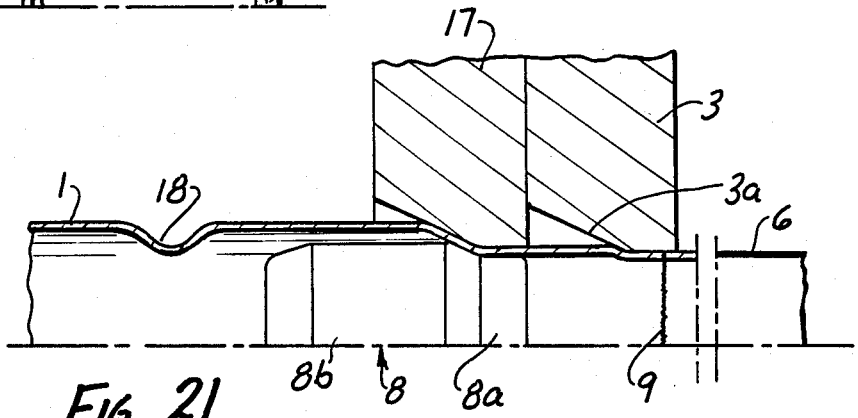
FIG. 21 is again similar to FIGS. 13–16 but with a supplemental feature.

FIG. 21 illustrates a particular advantageous example of the invention. Here there is again provided a divided quasi or pseudo-die 17 which is almost identical with the regular die 3, only the inner diameter is a little larger than the inner diameter of the die 3. The drawing gap between quasidie 17 and the part 8*a* of the mandrel 8 does not provide for any significant wall thickness reduction, rather the tubing 3 will be hollow drawn in this case with fairly low forces. Since the regular drawing die 3 is usually received a thicker wall tubing the hollow drawn tubing will be caused by the die 3 to be reduced in diameter. In order to reduce this particular diameter reduction furthers the inner diameter of the quasidie 17 can be constructed so that a relatively small thickness reduction obtains in the gap between part 8*a* and the quasidie 17. This is a measured step and it is very clear that this wall thickness reduction must not be sufficiently strong so that forces arising in the joint area exceed the strength limit; the welding seam must not tear.

Upon reducing the diameter reduction internally one makes sure that in the following drawing steps the respective mandrel 8 with its part 8*b* is never larger than the inner diameter of the tubing wherever the hollow drawn step has taken place. In order to reduce further the force needed for the hollow drawing it may be of advantage to have the previously hollow drawn tubular area and zone soft annealed prior to the next drawing step.

In the following a sequence of drawing steps will be described in order to demonstrate the invention further. It is assumed that hollows made through the pilgrim step method and having a length of 80 m at a 300 kg weight and an outer diameter of 58 mm are made originally with a wall thickness of 2.5 mm, and these tubings are welded together through arc welding under protective gas atmosphere. The drawing step can be carried out under utilization of three pulling machines and provide for the following change.

TABLE 1

| DRAW | DIAMETER 8b | DIAMETER 8a |
|---|---|---|
| 48 mm × 2.08 mm | 48.2 mm | 43.84 mm |
| 38.5 mm × 1.75 mm | 38.7 mm | 35.00 mm |
| 31 mm × 1.48 mm | 31.2 mm | 28.04 mm |

From the drawn tubular length the hollow drawn portions will be removed, and tubes of 31 by 1.48 made in accordance with the last drawn step are welded together anew and coiled to a weight of about 5 to 10 metric tons/coil. Thereafter continuous drawing can be continued as follows.

TABLE 2

| DRAW | DIAMETER 8b | DIAMETER 8a |
|---|---|---|
| 24 mm × 1.26 mm | 24.2 mm | 21.48 mm |
| 19 mm × 1.09 mm | 19.2 mm | 16.82 mm |
| 15 mm × 0.95 mm | 15.2 mm | 13.1 mm |

In these examples one can see that the pulling force will in fact act behind the welding seam 9 after the mandrel 8 was returned to the zone of action of the die 3. This precautionary step may not be necessary any longer if after a number of drawing steps the wall thickness of the drawn tube is reduced to such an extent that the drawing forces for subsequent normal drawing steps are very low. Here one has available the larger wall thickness wherever there is a welding seam, and this increase in wall thickness, as compared with the rest of the wall, suffices to take up normal drawing forces. This is particularly so because after several hollow drawn steps as defined above the casting texture in the welding seam 9 is actually changed to a kind of texture which will obtain particularly if the welding seam area was annealled. Consequently in later drawing steps the action of drawing may well be taken up by the welding seam.

The invention is not limited to the embodiments described above but all changes and modifications thereof, not constituting departures from the spirit and scope of the invention, are intended to be included.

I claim:

1. Method for drawing seamless metal tubing particularly copper tubing under inclusion of a floating mandrel and a diameter reducing die wherein the wall thickness is reduced under cooperation of the mandrel and of the die in an action zone defined by a drawing gap between the mandrel and the die, there being means to apply a drawing force to the drawn tube downstream from the die, comprising the steps of:

connecting a plurality of tubings end-to-end to each other thereby providing a joint in each instance of connection; normally and regularly drawing the tubing in portions not having any joint;

shifting the mandrel away from the action zone of the die as a joint between two of said tubings approaches the mandrel and keeping the mandrel out of the action zone in relation to the die as the joint passes through the die;

hollow drawing the tubing so that as a consequence of the shifting step, only a portion of the combined tubing including the joint is deformed, for a diameter reduction without concurring wall thickness reduction;

returning the mandrel to the action zone of the die following passage of the joint through the die; and applying a pulling force to resume drawing to be effective downstream from the die but upstream from the joint that just passed through the die.

2. Method as in claim 1 wherein said connection includes one of the following bonding, soldering, welding.

3. Method as in claim 2 including the step of butt welding end-to-end said tube lengths.

4. Method as in claim 1 including providing cut-outs near the tube ends so that tooling can reach from the outside into the interior of the tubing adjacent the joint area.

5. Method as in claim 4 including the step of engaging the mandrel through the cut-outs from the outside for said keeping and shifting.

6. Method as in claim 1 including electromagnetically keeping the mandrel.

7. Method as in claim 1 including the step of reducing the outer diameter of the tubing in the area of the joint.

8. Method as in claim 1 and including the step of widening the inner diameter of the tubing in the area where there is no reduction in wall thickness.

9. Method for drawing seamless metal tubing particularly copper tubing under inclusion of a floating mandrel and a diameter reducing die wherein the wall thickness is reduced under cooperation of the mandrel and of the die in an action zone defined by a drawing gap between the mandrel and the die, there being means to apply a drawing force to the drawn tube downstream from the die, comprising the steps of:

connecting a plurality of tubings end-to-end to each other thereby providing a jooint in each instance of connection;

normally and regularly drawing the tubing in portions not having any joint;

shifting the die in the direction of drawing while holding the mandrel as the joint approaches;

hollow drawing the tubing in and adjacent to the joint without the mandrel being in the action zone of the die for reducing the diameter of the tubing with little or no reduction in the wall thickness;

returning the mandrel in the action zone of the die after the joint has passed through the die and resume drawing.

10. Method as in claim 9 providing a limited force as between the die and the mandrel in radial direction of the tube to deform at least a part of the wall of the tubing to a limited extent, just sufficient so that the mandrel is retained by the deformed tubing as the die is displaced.

11. Method as in claim 10 and impeding passage of the tubing through the die during displacement of the die and during the onset of the effectiveness of said force.

12. Method as in claim 9 including the step of returning the die after the mandrel has reentered the action zone of the die.

13. Method as in claim 9 wherein during the drawing said die is shifted in a direction opposite the direction of drawing and, further including the steps of interrupting the passage of the tubing, the die being shifted during the interruption in the diection of drawing and causing prior to resumption of movement of the tube said deforming force to act on the tube.

14. Method as in claim 9 comprising the additional step of using a partitioned and suitably placed supplemental die for hollow drawing the joint area such that the outer diameter of the tubing is smaller than the largest diameter of the mandrel.

15. Method as in claim 14 comprising the step of using a supplemental die whose inner diameter is larger than the diameter of the principal die for the holding of the mandrel.

16. Method as in claim 7 comprising the additional step of using roller means for the reducing of the tube upstream from the die.

17. Method as in claim 1 including the step of adding indents to the tubing for obtaining the beeping of the mandrel.

18. Method as in claim 1 and including the step of soft annealing said hollow drawn zones.

19. Method as in claim 1 including electromagnetically shifting the mandrel.

* * * * *